US006454620B1

(12) United States Patent
Theisen et al.

(10) Patent No.: US 6,454,620 B1
(45) Date of Patent: Sep. 24, 2002

(54) INTEGRATED EXTERNAL HYDRAULIC TRIMMING AND STEERING SYSTEM FOR AN EXTENDED STERNDRIVE TRANSOM ASSEMBLY

(75) Inventors: Thomas G. Theisen; Gary J. Schaub, both of Fond du Lac; George Moses, Malone; John C. Leroux, Oshkosh, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/004,602

(22) Filed: Nov. 1, 2001

(51) Int. Cl.[7] ..... B63H 5/25
(52) U.S. Cl. ..... 440/61; 440/57; 114/150
(58) Field of Search ..... 440/57, 61; 114/150

(56) References Cited

U.S. PATENT DOCUMENTS

| | | | | |
|---|---|---|---|---|
| 2,976,833 A | * | 3/1961 | Dye, Jr. | 114/144 R |
| 3,384,046 A | * | 5/1968 | Stuteville | 114/150 |
| 3,847,107 A | | 11/1974 | Buddrus | 115/35 |
| 3,888,203 A | | 6/1975 | Lohse | 115/41 |
| 4,498,871 A | | 2/1985 | Hall et al. | 440/61 |
| 4,615,290 A | | 10/1986 | Hall | 114/150 |
| 4,645,463 A | | 2/1987 | Arneson | 440/57 |
| 4,836,810 A | | 6/1989 | Entringer | 440/61 |
| 5,002,510 A | | 3/1991 | Rump | 440/61 |
| 5,358,435 A | | 10/1994 | Rodskier | 440/61 |
| 5,372,529 A | | 12/1994 | Binversie | 440/61 |
| 5,466,178 A | | 11/1995 | Inman et al. | 440/61 |
| 5,562,508 A | * | 10/1996 | Rodskier et al. | 440/61 |
| 5,755,604 A | | 5/1998 | Borgersen | 440/56 |
| 6,287,160 B1 | | 9/2001 | Onoue | 440/61 |

FOREIGN PATENT DOCUMENTS

| | | | |
|---|---|---|---|
| GB | 2 174 660 | * 11/1986 | 440/6 |

* cited by examiner

*Primary Examiner*—Sherman Basinger
(74) *Attorney, Agent, or Firm*—William D. Lanyi

(57) ABSTRACT

A marine propulsion system is provided with a drive unit that is attachable to a transom of a marine vessel and provided with steering cylinder assemblies and trimming cylinder assemblies which are connected to a common location on a structural member, such as a gimbal ring. This arrangement improves the geometric relationship between the steering and trimming functions. In addition, the hydraulic steering system is provided with pressure relief valves that are located at the transom of the marine vessel in order to shorten the distance of the hydraulic conduits extending between the pressure relief valves and the steering cylinders.

20 Claims, 9 Drawing Sheets

INTEGRATED EXTERNAL HYDRAULIC TRIMMING AND STEERING SYSTEM FOR AN EXTENDED STERNDRIVE TRANSOM ASSEMBLY

BACKGROUND OF THE INVENTION

1. Field of the Invention

The present invention is generally related to an extended sterndrive transom assembly with trim and steering cylinders and, more particularly, to a system which advantageously positions trim and steering cylinder components and related hydraulic devices for more effective control of the outdrive unit.

2. Description of the Prior Art

Various types of sterndrive marine propulsion systems are well known to those skilled in the art. In addition to the sterndrive systems available in commercial quantities from manufacturers, such as the Mercury Marine division of Brunswick Corporation, several aftermarket products are available which can be installed for use in conjunction with sterndrive systems.

U.S. Pat. No. 3,888,203, which issued to Lohse on Jun. 10, 1975, discloses a sterndrive for boats. Two hydraulic cylinders, one on each side of the sterndrive and disposed between the tilt housing and the dirigible unit, steer the latter on the axis of the vertical drive shaft. The tilt housing is carried by lateral trunnions rotatable in bearings of the transom mounting on a transverse axis generally passing near the center of the universal joint in the horizontal driveshaft which extends through the transom. A trim adjustment and power tilt cylinder is disposed between the tilt housing and the transom mounting. The dirigible unit is suspended by the vertical driveshaft from an upper gear housing which, in turn, is removably secured to the tilt housing. The vertical driveshaft is protected from thrust and impact stresses by a steering support tube constituting a part of the dirigible unit and surrounding the shaft within a sleeve of the upper gear housing.

U.S. Pat. No. 4,645,463, which issued to Arneson on Feb. 24, 1987, describes a marine outdrive apparatus. The outdrive is attachable to the transom of a boat having an inboard engine. The marine outdrive includes a tubular support casing securable to and extendable rearwardly of the boat's transom and having a ball socket at its rear end. The ball socket receives a ball at the front end of a tubular, propeller shaft carrier having a conical outer surface. A driveshaft connectable to the inboard engine is journalled in the support casing. A propeller shaft is journalled in the propeller shaft carrier and has a propeller mounted thereon at the rear end of the propeller shaft carrier. A universal joint couples the two shafts together, the center of such joint substantially coinciding with the point about which the ball pivots within the socket. Hydraulic steering cylinders are attached to the propeller shaft carrier to pivot the latter about a steering axis extending through the pivot point of the ball. A hydraulic trim cylinder extends between the transom and the propeller shaft carrier to swing the propeller shaft carrier about a laterally extending trim axis extending through the pivot point of the ball. The upper end of the trim cylinder is pivotally mounting on the transom at a location above and vertically aligned with the pivot point of the ball or at a location above and forwardly of such pivot point. Improved fins are provided on the propeller shaft carrier near the propeller to stabilize the boat. The driveshaft of the inboard motor can be directly connected to the joint or offset from the joint and coupled thereto by a vertically extending transmission.

U.S. Pat. No. 5,755,604, which issued to Borgersen on May 26, 1998, describes a boat propeller drive unit. The drive unit comprises a frame-like carrier intended to be fixedly joined to a boat transom, and a propeller rig which is suspended in a fork for trim and tilting movement relative to the fork about a horizontal axis. The fork, in turn, is mounted in the carrier for pivoting about a vertical steering axis. A pair of hydraulically operated piston cylinder devices are pivotally joined at opposite ends to the rig and to the legs of the fork.

U.S. Pat. No. 5,372,529, which issued to Binversie et al on Dec. 13, 1994, describes a trim assembly. A marine propulsion device comprises a transom bracket adapted to be mounted on a boat transom, a swivel bracket supported on the transom bracket for pivotal movement about a generally horizontal tilt axis, a propulsion unit mounted on the swivel bracket for pivotal movement relative thereto about a generally vertical steering axis, a cylinder which is mounted on one of the swivel brackets and the transom bracket and which has a tapered inner surface defining an open end, a piston slidably housed by the cylinder, a rod having a first end connected to the piston and a second end extending from the open end of the cylinder, a mechanism for transmitting thrust forces from the other of the transom brackets the swivel bracket to the second end of the rod, and an end cap surrounding the rod and having a tapered outer surface engaged with the tapered inner surface of the cylinder.

U.S. Pat. No. 5,002,510, which issued to Rump on Mar. 26, 1991, describes a steering mechanism for a marine propulsion device. The invention provides a hydraulic steering assembly for a marine propulsion unit in which the axis of the cylinder travels parallel to the axis of the propulsion unit tilt axis during pivotal steering of the propulsion unit. The steering assembly provides two, two-bar link arms interconnecting the tilt tube and cylinder rod.

U.S. Pat. No. 4,615,290, which issued to Hall on Oct. 7, 1986, describes a marine propulsion steering assist device. The device comprises a propulsion unit pivotable about a first steering axis to steer a marine vehicle. It also comprises a trim tab mounted on the propulsion unit and pivotable about a second steering axis for assisting in steering the vehicle. The invention comprises a hydraulic sensing arrangement for sensing torque on the propulsion unit relative to the first steering axis to pivot the trim tab in response to the torque.

U.S. Pat. No. 4,498,871, which issued to Hall et al on Feb. 12, 1985, describes a hydraulic system for marine propulsion device with sequentially operating tilt and trim means. A marine propulsion device comprises a first pivot connecting a stem bracket to a transom bracket for pivotal movement therebetween about a first pivot axis which is horizontal when the transom bracket is boat mounted, a second pivot connecting the swivel bracket to the stem bracket for pivotal movement of the swivel bracket with the stem bracket and relative to the stern bracket about a second pivot axis parallel to the first pivot axis. A propulsion unit includes, at the lower end thereof, a rotatably mounted propeller and connected to the swivel bracket for steering movement therebetween and for common pivotal movement. A trim cylinder piston assembly is pivotally connected to the stem bracket and to the swivel bracket and includes first and second ends. A tilt cylinder piston assembly is pivotally connected to the transom bracket means and to the stem bracket and includes first and second ends. A hydraulic system is provided for sequentially operating the tilt and trim cylinder piston assemblies.

U.S. Pat. No. 3,847,107, which issued to Buddrus on Nov. 12, 1974, describes a hydraulic marine propulsion and guidance system. The system is intended for use with a marine vessel and consists of a fluid pressure generating system and a helm pressure generating unit located within the vessel, a tilting fluid actuator mounted to the transom of the vessel, a lift clevis operatively connected to the shaft of the tilting actuator, and a rotary fluid actuator mounted within the lift clevis. A steering clevis is operatively connected to the shaft of the rotary fluid actuator and a fluid motor propeller assembly is secured to the steering clevis. An additional fluid pump is located within the vessel and fluid conduits are operatively connecting the same to the tilting actuator such that as the pump is operated the shaft of the tilting actuator rotates the lift clevis in turn tilting the fluid motor propeller assembly. Further fluid conduits are operatively connecting the helm pressure generating unit and the rotary actuator such that as the helm pressure generating unit is operated the shaft of the rotary actuator rotates the steering clevis and the fluid motor propeller assemblies. The fluid conduit includes single passage oscillating swivels mounted to the transom along a common axis defining the center of rotation of the lift clevis. Still further conduits are used to connect the fluid pressure generating system and the fluid motor including a multiple passage oscillating swivel operatively mounted to the steering clevis and aligned with respect to the axis of rotation of the steering clevis.

U.S. Pat. No. 6,287,160, which issued to Onoue on Sep. 11, 2001, describes a tilt and trim arrangement for a marine propulsion system. The arrangement for a marine propulsion system includes an improved construction. A swivel bracket, which carries a drive unit for pivotal movement about a steering axis includes a pair of ribs spaced apart transversely from each other. A clamping bracket is affixed to an associated watercraft and supports the swivel bracket for pivot movement about a tilt axis. A hydraulic tilt device is provided for tilting the swivel bracket. The tilt device includes a cylinder housing, a piston slidably supported within the housing, and a piston rod affixed to the piston. The cylinder housing has an upper section with a diameter that is smaller than a lower section, and the piston rod extends outwardly from the upper section. The piston rod is pivotally affixed to the ribs. The upper section of the cylinder housing is generally positioned between the ribs at least when the piston rod is fully retracted within the cylinder housing.

U.S. Pat. No. 4,836,810, which issued to Entringer on Jun. 6, 1989, discloses a combined power trim and steering system. The power steering and trim functions of a marine drive unit are combined in a fluid pressure supply system which utilizes a single electric motor drive hydraulic pump to provide operating fluid for both functions. Fluid pressure to operate the power steering is supplied by an actuator which is, in turn, charged by the hydraulic pump. The pump is also operable in response to operator input to supply fluid pressure from the trim system. Appropriate controls responsive to the upper and lower pressures limits of the accumulator, are used both for charging the accumulator and for providing operational priority to the power steering system by disabling operation of the trim system during charging of the accumulator.

U.S. Pat. No. 5,358,435, which issued to Rodskier on Oct. 25, 1994, describes a boat propulsion unit. The unit comprises a suspension arrangement and a propeller drive shaft housing which, via a lower end and upper universal joint, are pivotally connected to each other. A hydraulic piston cylinder arrangement has its cylinder connected to the upper joint and, at the lower end of its piston rod, presents a forked bracket which is pivotally connected to an upper region of the driveshaft housing. At a distance from the upper joint, the cylinder of the arrangement presents attachments for a steering mechanism, by means of which the arrangement is displaceable about a vertical axis. The embodiment implies that the piston cylinder arrangement serves both as a trim and tilt cylinder are well as a rudder.

Various types of hydraulic steering systems are available to owners from companies that provide aftermarket goods. Certain types of hydraulic steering assemblies, intended for use with marine propulsion systems, are available in commercial quantities from the Inman Marine Corporation. The steering assemblies available from the Inman Marine Corporation can be added to existing marine propulsion systems in order to provide certain types of steering systems for marine vessel.

U.S. Pat. No. 5,466,178, which issued to Inman et al on Nov. 14, 1995, describes a load-relieving external steering system for marine outdrive units. A load-relieving external steering systems for marine outdrive units comprises a first hydraulic steering ram having a piston partially disposed within a housing, wherein the piston is attached to one side of an outdrive unit and the housing is attached to an adjacent portion of a transom. A second hydraulic steering ram has a piston partially disposed within a housing, wherein the piston of the second steering ram is attached to an opposite side of the outdrive unit and the housing of the second steering ram is attached to an adjacent portion of the transom. The first and second steering rams are mounted in a common horizontal plane between the outdrive unit and the transom. The housing of each steering ram comprises a front chamber and a rear chamber. A hydraulic pump for providing hydraulic fluid at a constant pressure is connected to the rear chamber of each steering ram. A hydraulic pump and a control valve for providing hydraulic fluid at a variable pressure is connected to the front chamber of each steering ram, wherein the hydraulic pressure at a variable pressure is routed to a particular front chamber to effect the steering of the vessel in a desired direction. At all times the hydraulic fluid at constant pressure routed to each rear chamber imposes a forwardly directed compression force onto an upper steering bearing to counteract a static and/or dynamic tension load and, thereby enhance the service lift of the upper steering bearing.

The patents described above are hereby expressly incorporated by reference in the description of the present invention.

SUMMARY OF THE INVENTION

A marine propulsion system, made in accordance with the preferred embodiment of the present invention comprises a drive unit that is attachable to a transom of a marine vessel. The drive unit comprises a fixed portion and a moveable portion. The moveable portion of the drive unit is independently rotatable about both a generally vertical steering axis and a generally horizontal trimming axis. Although the steering axis is described as being generally vertical and the trimming axis is described as being generally horizontal, it should be understood that variations from the absolute vertical and horizontal planes are also within the scope of the present invention.

A steering cylinder assembly extends between first and second structural members of the propulsion system. A first end of the steering cylinder assembly is pivotally attached to the first structural member which is rigidly attached to the transom of a marine vessel. A second end of the steering cylinder assembly is pivotally attached to the second structural member which is rigidly attached to a moveable portion of the drive unit. The moveable portion of the drive unit is rotatable about the steering axis in response to a change in the effective distance is between the first and second structural members.

A trim cylinder assembly extends between the second structural member and a third structural member. A first end of the trim cylinder assembly is pivotally attached to the second structural member and a second end of the trim cylinder assembly is pivotally attached to a third structural member which is rigidly attached to the moveable portion of the drive unit. The moveable portion of the drive unit is rotatable about the trimming axis in response to a change in the effective distance between the second and third structural members.

The moveable portion of the drive unit comprises a steering segment and a trimming segment. The steering segment is rotatable about the steering axis and the trimming segment is rotatable about the trimming axis. The second structural member is rigidly attached to the steering segment and the third structural member is rigidly attached to the trimming segment.

The steering cylinder assembly comprises a steering piston disposed within a steering cylinder, with the steering piston being moveable relative to the steering cylinder in order to cause the change in the effective distance between the first and structural members. As is well known to those skilled in the art, the steering piston is attached to a rod, or shaft, which moves in coordination with the steering piston in response to changes in pressure within the steering cylinder. The steering piston is pivotally attached to the second structural member and the steering cylinder is pivotally attached to the first structural member.

The trim cylinder assembly comprises a trim piston disposed within a trim cylinder, with the trim piston being moveable relative to the trim cylinder in order to cause the change in the effective distance between the second and third structural members. The trim piston is pivotally attached to the third structural member and the trim cylinder is pivotally attached to the second structural member. The second end of the steering cylinder assembly is pivotable about a first axis which is fixed in relation to the second structural member. The first end of the trim cylinder assembly is pivotable about a second axis which is in fixed relation with the second structural member. The first and second axes are in fixed relation with each other and with the second structural member.

Certain embodiments of the present invention further comprise a hydraulic pump and a hydraulic conduit which has a first portion and a second portion. The pump is typically attached to an engine and driven by an accessory belt which is driven by the engine. The hydraulic conduit is connected between the steering cylinder assembly and the hydraulic pump. A steering mechanism is operatively associated with the hydraulic conduit to affect a pressure magnitude within the hydraulic conduit and cause the steering cylinder assembly to change the effective distance between the first and second structural members. A pressure relief valve is connected in fluid communication with the hydraulic conduit for limiting a hydraulic pressure magnitude within the hydraulic conduit. The first portion of the hydraulic conduit is connected in fluid communication between the steering mechanism and the pressure relief valve. The second portion of the hydraulic conduit is connected in fluid communication between the steering cylinder assembly and the pressure relief valve. The first portion of the hydraulic conduit is greater in length than the second portion of the hydraulic conduit and, in a particularly preferred embodiment of the present invention, the first portion of the hydraulic conduit is at least twice as long as the second portion of the hydraulic conduit.

It should be understood that the steering cylinder assembly and the trim cylinder assembly of the present invention typically are arranged in association with a symmetrical duplicate of each cylinder assembly. In other words, two steering cylinder assemblies (port and starboard) and two trim cylinder assemblies (port and starboard) are used in most applications of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
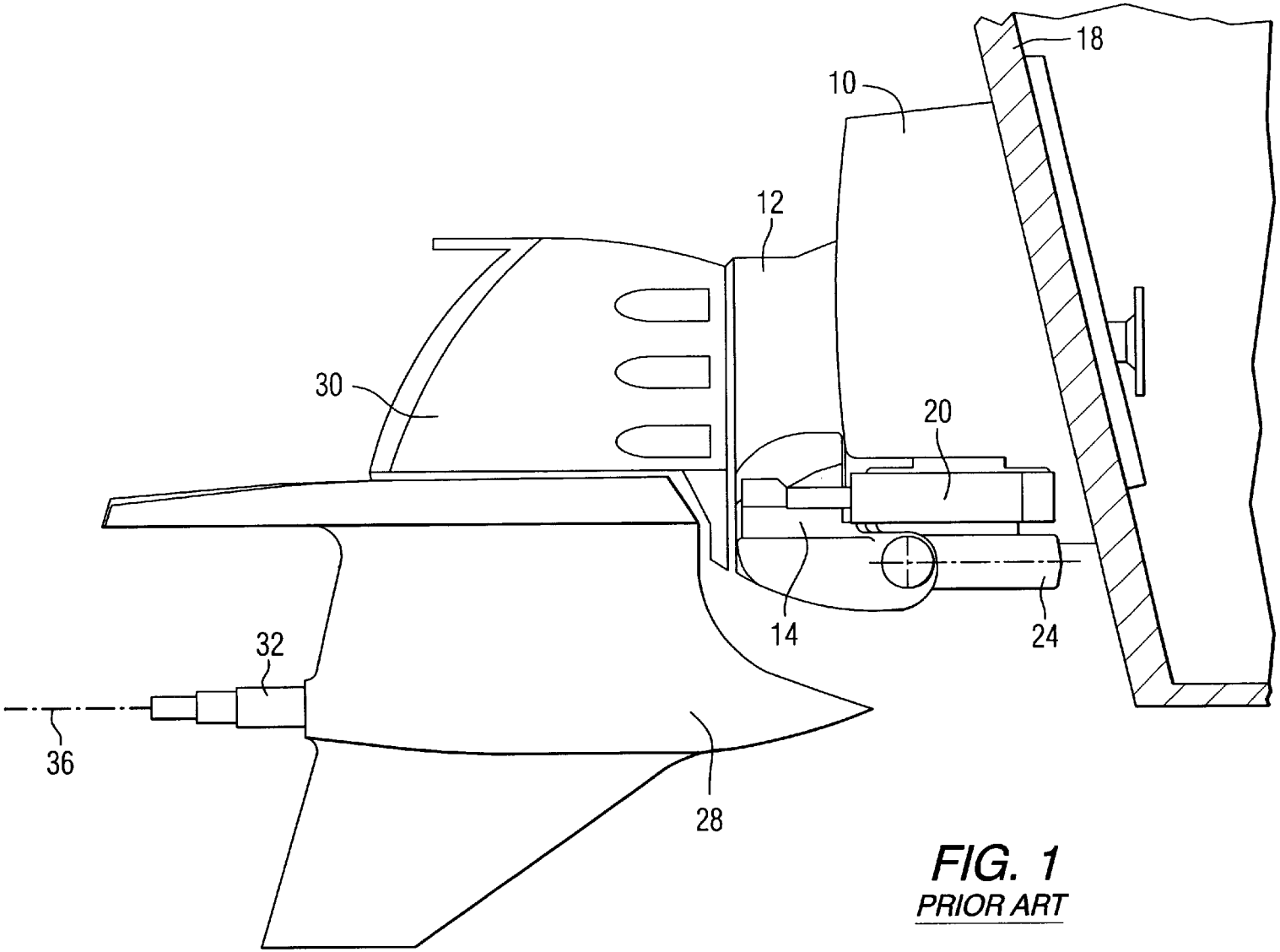
FIG. 1 PRIOR ART
FIG. 1 shows a marine propulsion system known to those skilled in the art.

Throughout the description of the preferred embodiment of the present invention, like components will be identified by like reference numerals.

FIG. 1 shows a known type of outdrive, or sterndrive unit, which has a gimbal housing 10, a bell housing 12, and a gimbal ring 14. The drive unit is rigidly attached to a transom 18 of a marine vessel. A steering cylinder 20 is provided on both the port and starboard sides of the drive unit to cause a moveable portion of the drive unit to rotate about a generally vertical steering axis. A single trim cylinder 24 is provided to cause the drive unit to rotate about a generally horizontal trimming axis. The moveable portion of the drive unit, which includes a gearcase 28,and a driveshaft housing 30, is rotatable about both the steering axis and the trimming axis. A propeller shaft 32 is supported by the gearcase 28 for rotation about a propeller shaft axis 36. Although no propeller is illustrated in FIG. 1, the propeller shaft 32 is intended to support a propeller for rotation about the propeller shaft axis 36, as is well known to those skilled in the art. Also not shown in FIG. 1 is an internal combustion engine that is supported within the marine vessel, forward of the transom 18, and the internal combustion engine has an output shaft that is connected in torque transmitting relation with a horizontal shaft that extends through both the gimbal housing and the bell housing and is connected in torque transmitting relation with a vertically disposed driveshaft that extends downward to the gearcase 28 to drive the propeller shaft 32.

Figure 2:
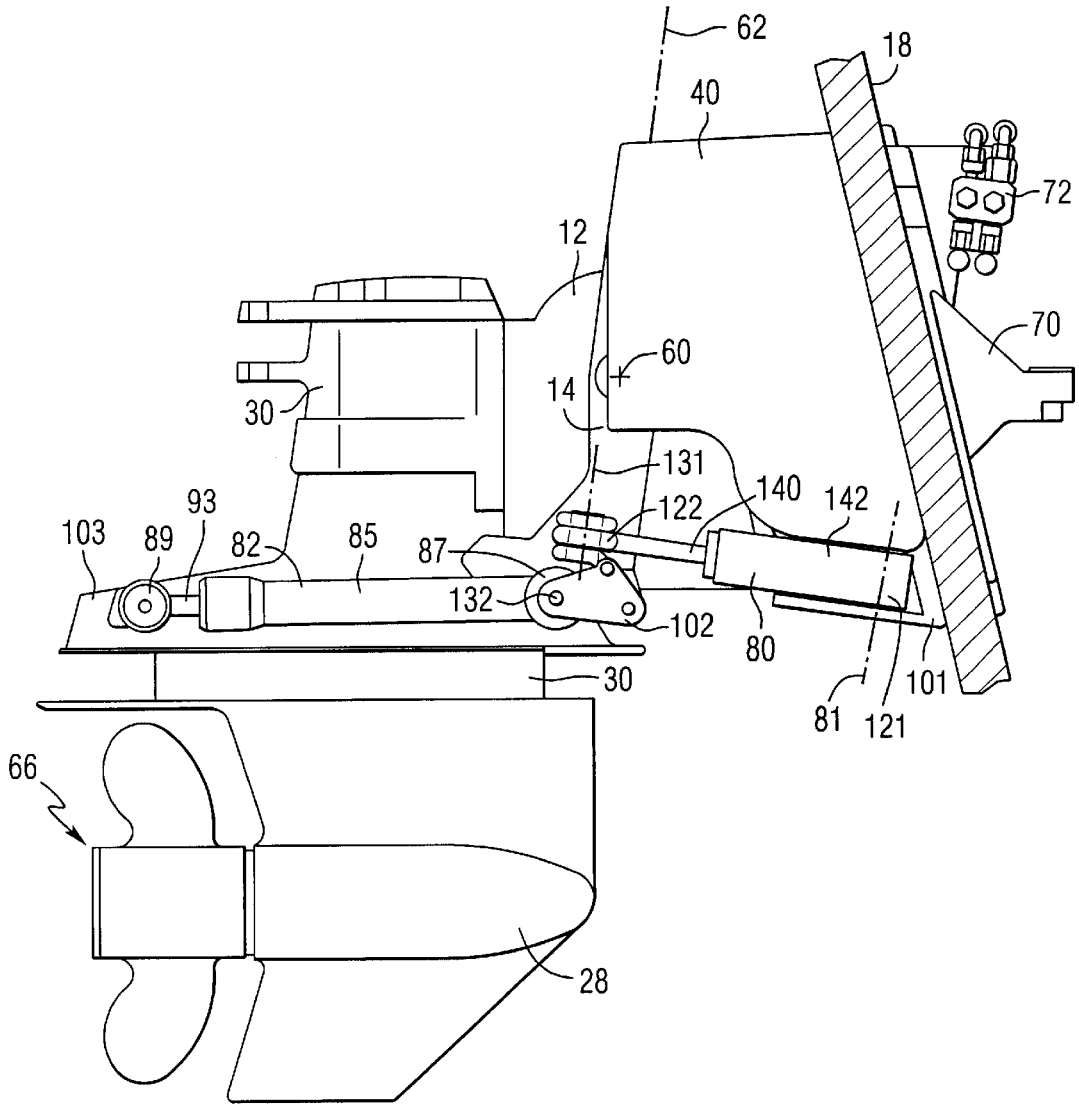
FIG. 2 is a side view of a marine propulsion system embodying the present invention.

FIG. 2 is a side view of a sterndrive unit made in accordance with the present invention. A gimbal housing 10, described above in conjunction with FIG. 1, is located under a cowl 40. A gimbal ring 14 and a bell housing 12 are associated with each other and with the gimbal housing 10 to allow a moveable portion of the drive unit to rotate about a generally horizontal trimming axis 60 and a generally vertical steering axis 62. The driveshaft housing 30 and the gearcase 28 are rotatable about both the trimming axis 60 and the steering axis 62. In FIG. 2, a propeller 66 is attached for rotation about the propeller shaft axis identified by reference numeral 36 in FIG. 1.

With continued reference to FIG. 2, on the forward side of the transom 18, an inner transom plate 70 and a hydraulic valve block 72 are illustrated. The hydraulic valve block 72, which comprises cross port relief valves, will be described in greater detail below. A steering cylinder 80 is provided on both the port and starboard sides of the drive unit. A trim cylinder 82 is also provided on both the port and starboard sides of the out drive unit. The purpose of the steering cylinders 80 is to cause the moveable portion of the drive unit to rotate about the steering axis 62. The purpose of the trim cylinders 82 is to cause the moveable portion of the drive unit to rotate about the trimming axis 60. Although not shown in FIG. 2, an internal combustion engine is supported within the marine vessel and a generally horizontal driveshaft extends through the transom 18 and through the gimbal housing, gimbal ring, and bell housing to extend into the driveshaft housing 30. Appropriate gearing is provided to connect the horizontal driveshaft with a vertically supported driveshaft within the driveshaft housing 30 which is connected in torque transmitting relation with the horizontally disposed propeller shaft described above in conjunction with FIG. 1. With continued reference to FIG. 2, the marine propulsion system made in accordance with the preferred embodiment of the present invention comprises a drive unit which includes the components which are located on the rearward side of the transom 18 and attachable to the transom of a marine vessel. These comprise the fixed portion, such as the gimbal housing 10 described above in conjunction with FIG. 1 and located under the cowl 40 in FIG. 2. The drive unit also comprises a moveable portion which comprises the bell housing 12 and gimbal ring 14 along with the driveshaft housing 30 and gearcase 28. The moveable portion of the drive unit is independently rotatable about a generally vertical steering axis 62 and about a generally horizontal trimming axis 60. The steering cylinder 80 extends between a first structural member 101 and a second structural member which includes the gimbal ring 14 and plate 102. A first end 121 of the steering cylinder assembly 80 is pivotally attached to the first structural member 101 which is rigidly attached to the transom 18. The pivot attachment of the first end 121 of the steering cylinder assembly 80 is attached for rotation about a pivot axis 81. A second end 122 of the steering cylinder assembly 80 is pivotally attached to the second structural member 102 and to the gimbal ring 14. The second end 122 of the steering cylinder assembly 80 is able to pivot about a first axis 131 relative to the second structural member 102. The second structural member 102 is rigidly attached to the moveable portion of the drive unit, which comprises the gimbal ring 14. As can be seen, the moveable portion of the drive unit is rotatable about the steering axis 62 in response to a change in the effective distance between the first and second structural member, 101 and 102, respectively. More specifically, movement of the steering piston 140 relative to the steering cylinder 142 will change the effective distance between axes 81 and 131 and, as a result, cause the moveable portion of the drive unit to rotate about the steering axis 62.

With continued reference to FIG. 2, the trim cylinder assembly 82 extends between the second structural member 102 and a third structural member 103. A first end 87 of the trim cylinder assembly 82 is pivotally attached to the second structural member 102 and a second end 89 of the trim cylinder assembly 82 is pivotally attached to a third structural member 103 which is rigidly attached to the moveable portion of the drive unit. More specifically, the third structural member 103 in FIG. 2 is a structurally rigid portion of the drive shaft housing 30 to which the second end 89 of the trim cylinder assembly 82 is pivotally attached. The moveable portion of the drive unit is rotatable about the trim axis 60 in response to a change in the effective distance between the second and third structural members, 102 and 103, respectively. The trim cylinder assembly 82 comprises a trim cylinder 85 and a trim piston to which the rod 93 is attached.

With continued reference to FIG. 2, the moveable portion of the drive unit comprises both a steering segment and a trimming segment. The steering segment comprises the gimbal ring 14 which is rotatable about steering axis 62. The gimbal ring 14 supports the bell housing 12 for rotation about the trimming axis 60. Therefore, the trimming segment of the moveable portion of the drive unit comprises the bell housing 12, the driveshaft housing 30 and the components supported by the driveshaft housing 30, such as the gearcase 3 8.

Figure 3:
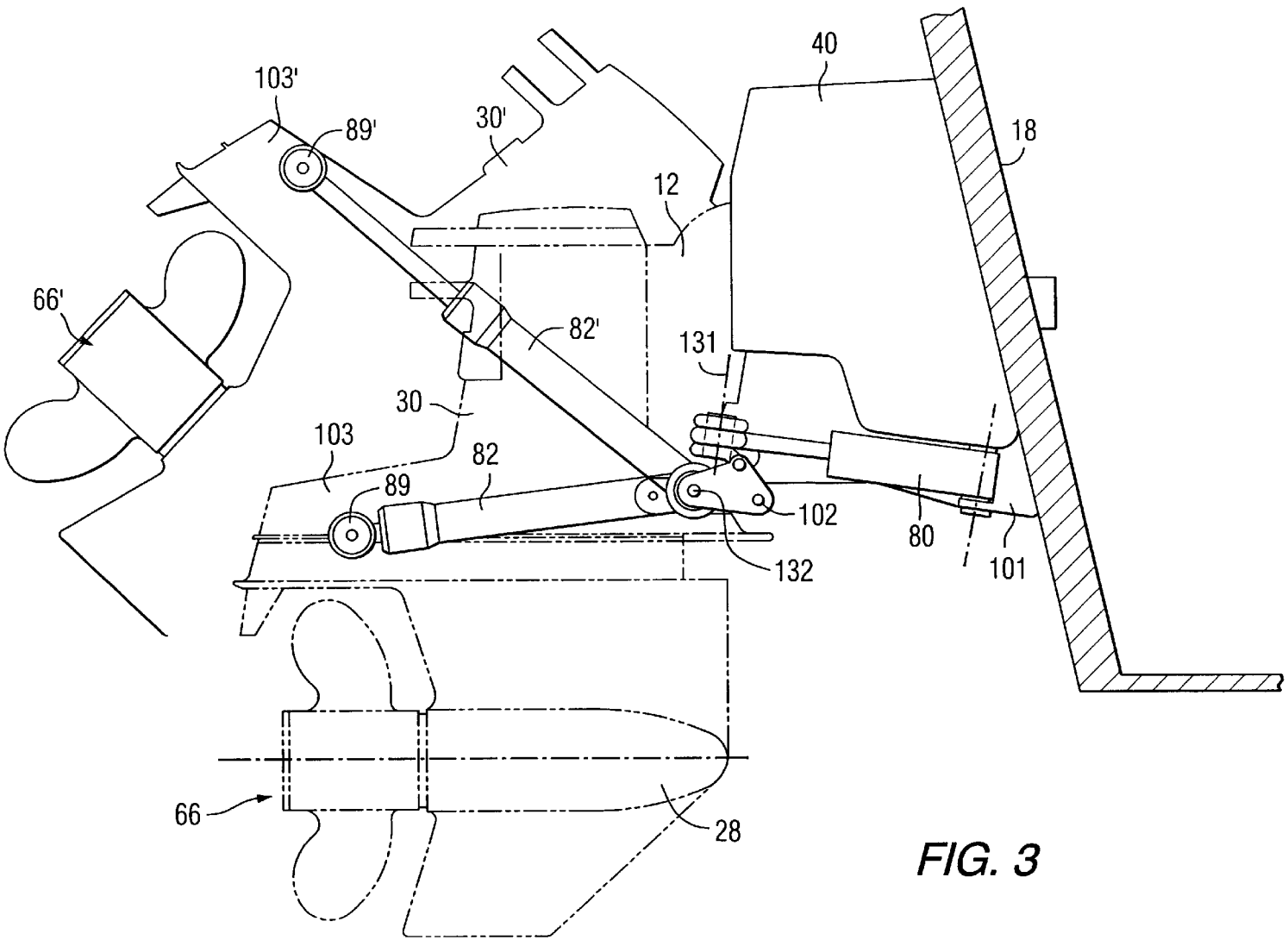
FIG. 3 is generally similar to FIG. 2, but showing two positions of the moveable portion of the drive unit.

FIG. 3 shows a marine propulsion unit made in accordance with the present invention. The moveable portion of the drive unit is illustrated in two alternative positions relative to the fixed portion of the drive unit. The dashed line version of the moveable portion is generally similar to the position illustrated in FIG. 2, but illustrated to show a slight variation in the configuration of the moveable portion of the drive unit. The trim cylinder assembly 82 is shown in the lowered position and the trim cylinder assembly 82' is shown in a raised position. Similarly, the second ends, 89 and 89', of the trim cylinder assembly are shown in the lowered and raised positions, respectively. The raised moveable portion of the drive unit is shown as a highly simplified silhouette line illustration for the purposes of simplifying the illustration and more clearly depicting the alternative positions shown.

With reference to FIGS. 2 and 3, certain characteristics of the present invention provide a significant benefit in the operation of the sterndrive unit. For example, the first axis 131, about which the second end 122 of the steering cylinder assembly 80 pivots, and the second axis 132, about which the first end 87 of the trim cylinder assembly pivots, are not moveable relative to each other. Instead, the first axis 131 and the second axis 132 are stationary with respect to each other and with respect to the second structural member 102. As described above, the second structural member 102 is also stationary with respect to the gimbal ring 14. This relationship of the steering cylinder assembly 80, the trim cylinder assembly 82, the second structural member 102, and the moveable portion of the drive unit provide smooth and efficient operation of the sterndrive unit and, in addition, provides a robust structure that is able to withstand the significant forces to which sterndrive units are subjected, particularly when used in high speed and racing applications.

Figure 4:
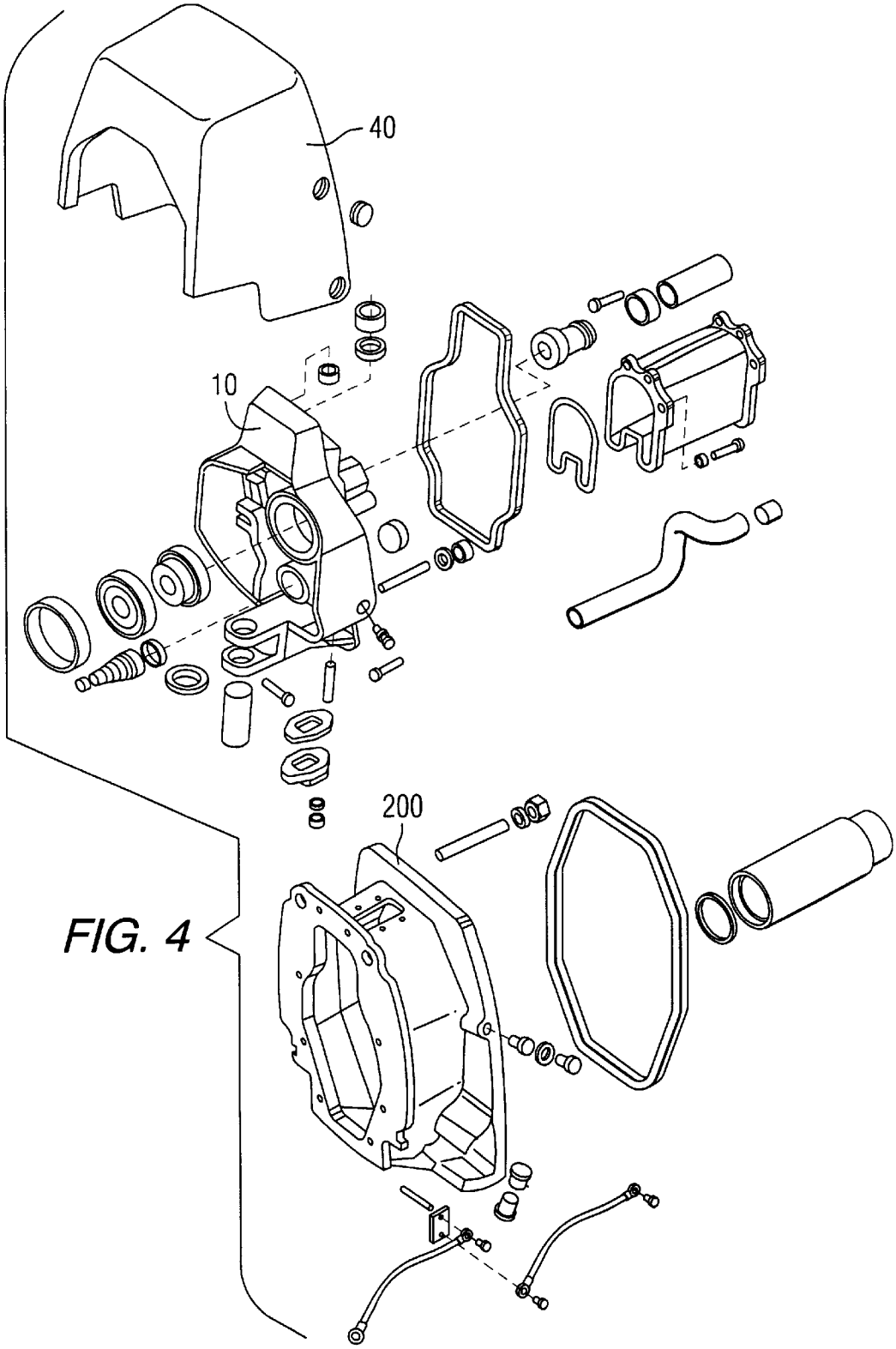
FIGS. 4, 5 and 6 show exploded views of various portions of the drive unit.

FIG. 4 is an exploded view showing several of the components described above in conjunction with FIG. 3. FIG. 4 shows the cowl 40, the gimbal housing 10 and an extension housing 200, in combination with other related components that are generally well known to those skilled in the art and will not be described in detail herein. The various gaskets, fasteners, tubes, and other hardware illustrated in FIG. 4 are not only well known to those skilled in the art, but do not directly relate to the basic concepts of the present invention.

Figure 5:
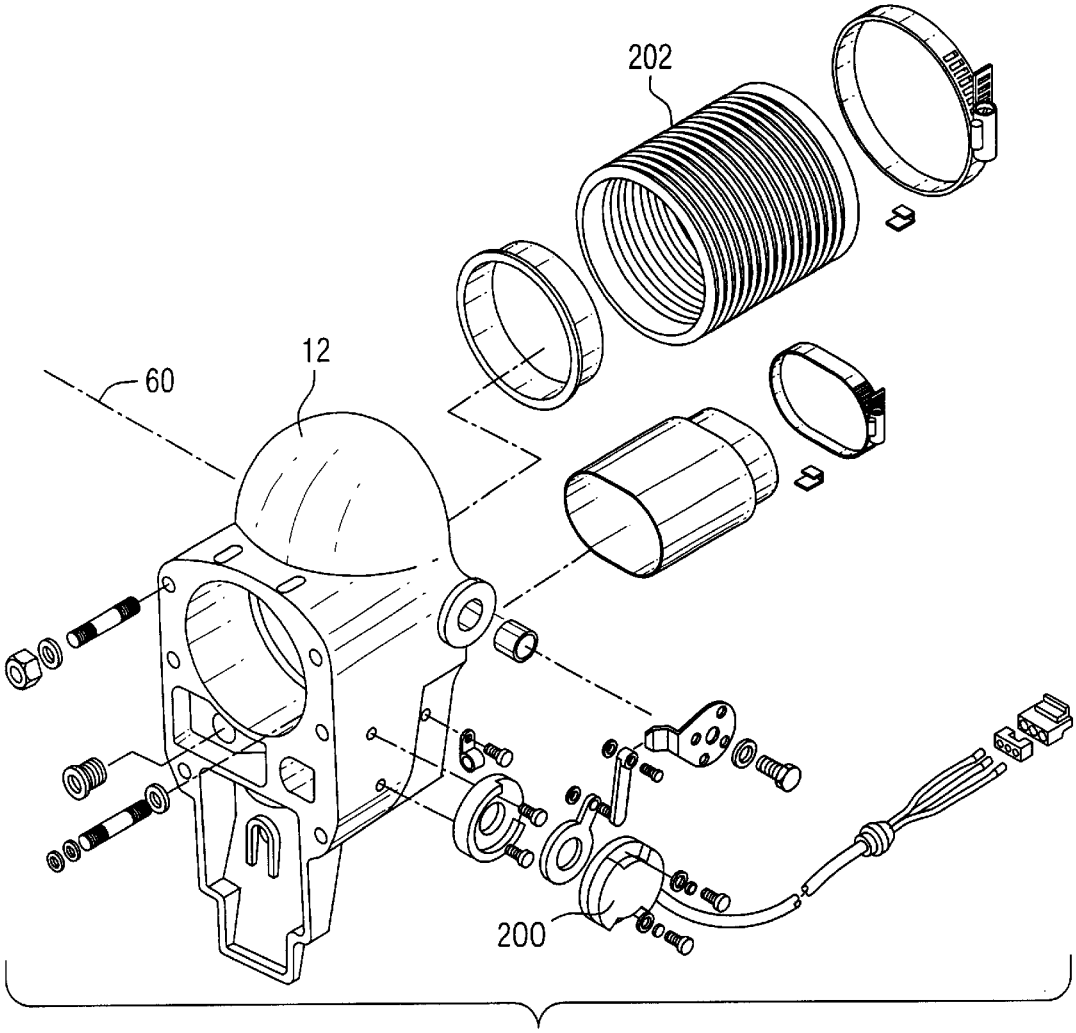

FIG. 5 is intended to show the bell housing 12 in relation to the trimming axis 60. Also shown in FIG. 5 are a rotation sensor 200, a bellows component 202, and other hardware that are well known to those skilled in the art. The relationship of the trimming axis 60 to the bell housing 12 is seen both in FIG. 5 and FIG. 2 which also shows the relationship between the bell housing 12 and the gimbal ring 14.

Figure 6:
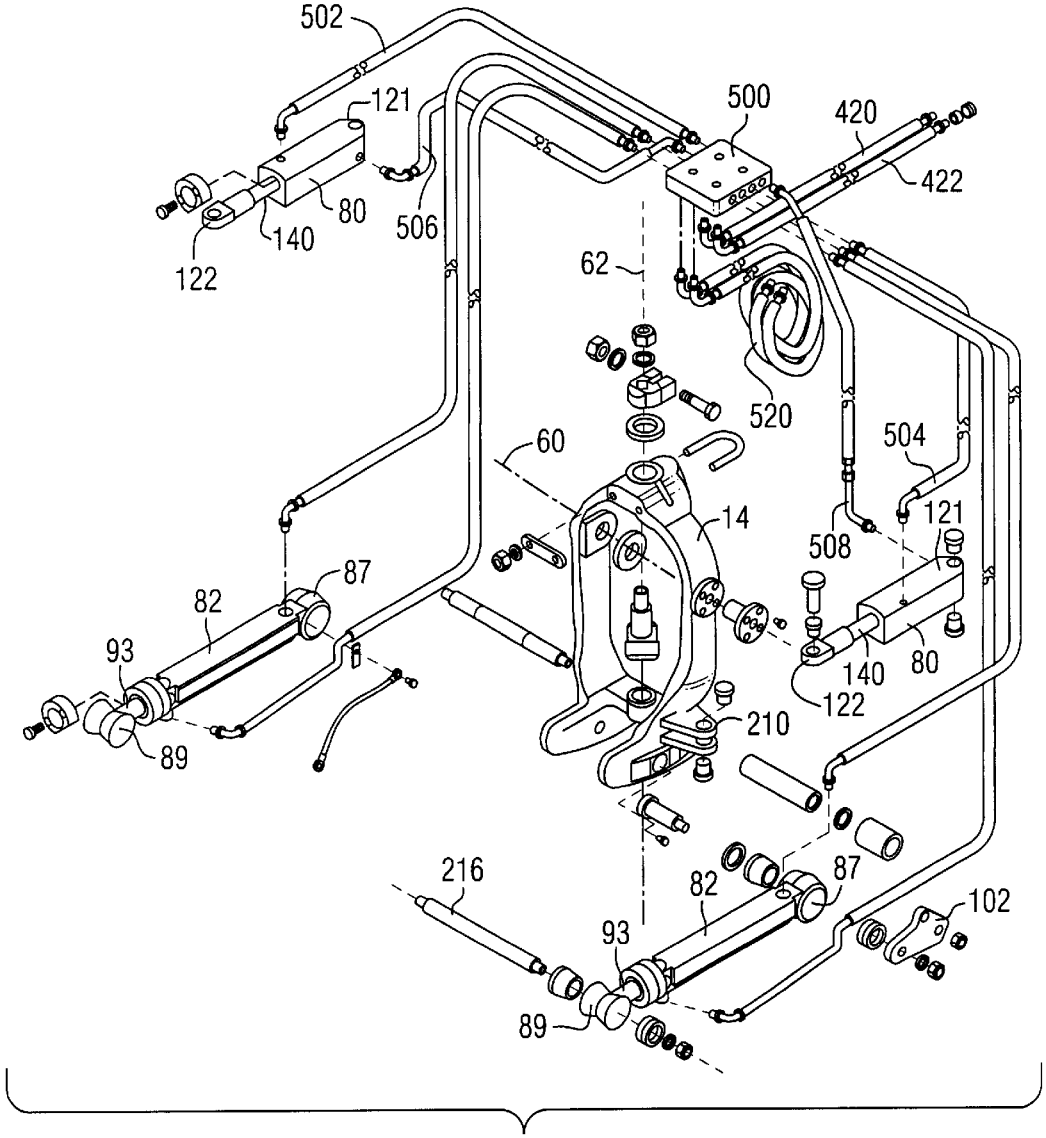

FIG. 6 shows the gimbal ring 14 in association with both the trimming axis 60 and the steering axis 62. The bell housing 12, described above, is supported by the gimbal ring 14 for rotation about the trimming axis 60. In addition, the gimbal ring 14 is supported by the gimbal housing 10 which is described above in conjunction with FIG. 1 and is disposed within the cowl 40 in FIG. 2.

With continued reference to FIG. 6, it can be seen that two steering cylinder assemblies 80 are provided, one on the starboard side of the drive and one on the port side. The second ends 122 of the steering cylinder assemblies 80 are attached to the gimbal ring 14. These attachments are provided by an extension 210 on both sides of the gimbal ring 14. This is a pivotal attachment that allows the second ends 122 to pivot about the first axis 131 described above in conjunction with FIG. 3. The trim cylinder assemblies 82 are shown with their second ends 89 associated with a pin 216 that extends through the third structural member 103 described above in conjunction with FIG. 3. The first ends 87 of the trim cylinder assemblies 82 are attached between the lower portion of the gimbal ring 14 and the second structural member 102. However, it should be understood that the rigid attachment between the second structural member 102 and the lower portion of the gimbal ring 14 combine to define that assembly as the second structural member 102.

With continued reference to FIGS. 3–6, it can be seen that movement of the steering piston rod 140 relative to its associated steering cylinder will change the distance between the first and second ends, 121 and 122, of the steering cylinder assembly 80 and will cause the gimbal ring 14 to rotate about the steering axis 62. Similarly, it can be seen that extension of the trimming piston rods 93 from the associated trimming cylinders will change the distance between the first ends 87 and second ends 89 of the trim cylinder assemblies 82 and, as a result, will cause the bell housing 12 to rotate about the trimming axis 60. Most importantly, it can be seen that the second end 122 of the steering cylinder assembly 80 is attached to the same structural component as the first end 87 of the trim cylinder assembly 82. The hydraulic circuit, represented by a plurality of conduits in FIG. 6 will be described in greater detail below.

Figure 7:
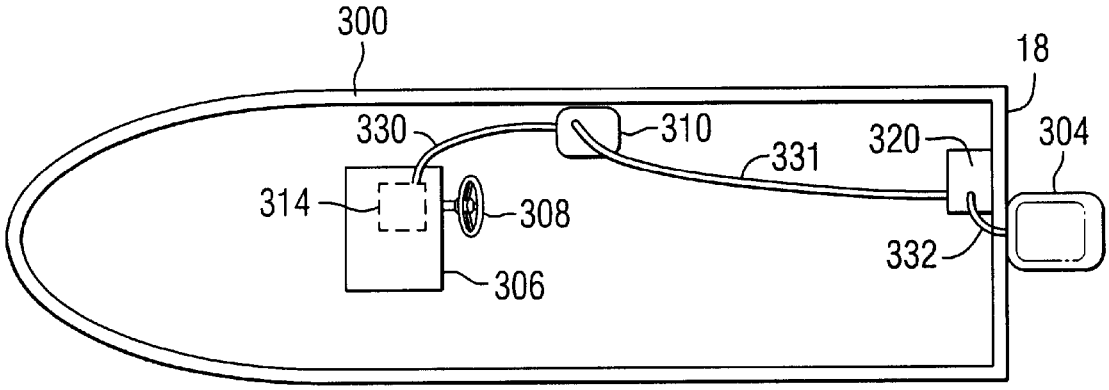
FIG. 7 is a simplified schematic of a marine vessel showing certain portions of its hydraulic steering system.

FIG. 7 is a highly schematic representation of a marine vessel 300 with an outdrive unit 304 attached to the transom 18. Also shown is a steering console 306 with a steering mechanism 308, such as a steering wheel where the operator of the marine vessel 300 would be positioned to control the movement of the marine vessel. A hydraulic pump 310 is positioned within the marine vessel 300 and associated with the steering mechanism 308. The pump 310 is normally located in the bilge of the boat and attached to an engine. A steering valve assembly 314 is associated with a steering wheel to change the relative pressures in the hydraulic conduit which is connected to the steering cylinder assemblies 80. Also shown in FIG. 7 is a pressure relief valve device 320 which will be described in greater detail below. The hydraulic conduit shown in FIG. 7 can be described as comprising two portions, a first portion and a second portion. The second portion of the hydraulic conduit is identified by reference numeral 332 and is connected in fluid communication between the steering cylinder assembly 80, which is associated with the outdrive 304, as described above, and the pressure relief valve device 320. The first portion of the hydraulic conduit is identified by reference numerals 330 and 331. For the purposes of this discussion, the two hydraulic conduits, 330 and 331, will be considered together as the first portion of the hydraulic conduit and the portion identified by reference numeral 332 will be considered the second portion of the hydraulic conduit. By locating the pressure relief valve device 320 at the rear portion of the marine vessel 300, and proximate the transom 18, the second portion 332 of the hydraulic conduit can be significantly shorter in length than the first portion. The location of the pressure relief valve is an important characteristic of the present invention for several reasons. One of the more important advantages provided by this location of the pressure relief valve 320 is that sudden changes in pressure within the hydraulic conduit can be reacted to much more quickly by the relief valve components in the pressure relief valve device 320. It must be recognized that the hydraulic conduits are often made of a material which is flexible. As a result, a sudden increase in pressure can cause the diameter of the conduit to expand. This expansion in diameter results in an increased cross sectional area of the conduit which, in turn, results in a lessening of the hydraulic pressure. When the drive unit is subjected to sudden forces, these forces create a pressure pulse in one of the hydraulic conduits. The relief valves are intended to relieve this pressure pulse. However, if the conduit expands in response to the pressure pulse and the pulse has to travel a significant distance, the reaction of the relief valves can be delayed. In many known applications of marine propulsion systems, pressure relief valves are located near the operator console 306 and much closer to the pump 310 and steering valve assembly 314 than to the drive 304 itself. In other words, it is not near the transom of the boat or the steering cylinders which are attached to the transom. As a result, the drive 304 can be subjected to significant structural loads during the time delay before the relief valves located at the operator's console 306 can act to relieve the pressure and allow the outdrive unit to move in response to the load rather than be subjected to damage. By providing a pressure relief valve device 320 at a location near the drive 304 the reaction time of the pressure relief components is significantly reduced.

With continued reference to FIG. 7, it should be understood that single conduits 330, 331, and 332 are illustrated in the FIG. but that, in a typical application of a marine propulsion system, pairs of conduits would be provided. This will be described and illustrated in greater detail below.

Figure 8:
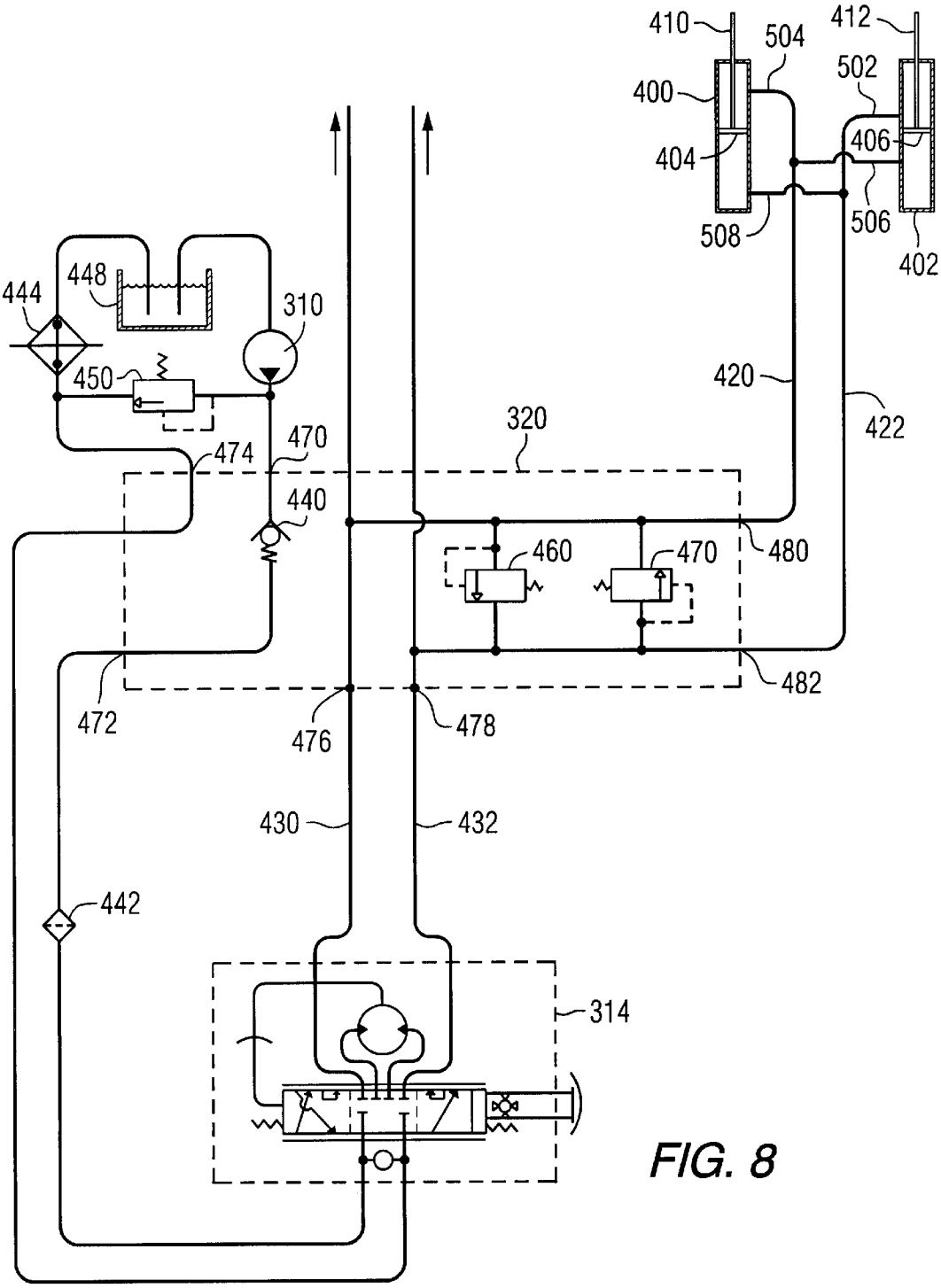
FIG. 8 is a hydraulic schematic of a steering system made in accordance with the present invention.

FIG. 8 shows a simplified hydraulic schematic diagram of a steering system which includes a pump 310, a steering valve device 314, a pair of steering cylinder assemblies, 400 and 402, and associated hydraulic conduits. It should be understood that the steering cylinder assemblies, 400 and 402, are representative of the steering cylinder assemblies 80 described above in conjunction with FIGS. 2, 3, and 6. The steering cylinder assemblies, 400 and 402, each comprise a piston, 404 and 406, respectively. The pistons are attached to rods, 410 and 412, which are representative of the piston rods 140 described above. For purposes of the description of FIG. 8, an increase in pressure in line 420 will cause the marine vessel to turn toward the right, conversely, an increase in pressure in hydraulic conduit 422 will cause the marine vessel to turn toward the left. As can be seen in the illustration, hydraulic conduit 420 is connected in front of piston 404 and behind piston 406. Similarly, hydraulic conduit 422 is connected in front of piston 406 and behind piston 404. As a result, the two steering cylinder assemblies, 400 and 402, work in coordination with each other. Hydraulic conduit 420 is connected to hydraulic conduit 430 as shown. The pressure in hydraulic conduit 430 is controlled by the actuation of the steering valve 314 which, in a preferred embodiment of the present invention, is a gerotor metering mechanism located at the helm, or operator's console 306 described above in FIG. 7. The pump 310 is typically located on or near the engine and is normally driven by a belt which is, in turn, driven by the engine. Hydraulic conduit 422, associated with a left turn, is connected to hydraulic conduit 432. Control of the steering mechanism 308 and the steering valve configuration 314, described above in conjunction with FIG. 7 and shown in greater detail in FIG. 8, controls the pressure within hydraulic conduits 420 and 422 and, as a result, controls the relative positions of the pistons, 404 and 406, within their associated steering cylinder assemblies, 400 and 402, respectively.

With continued reference to FIG. 8, the pump 310 is associated with a four PSI check valve 440 and a filter 442. A cooler 444 can be used in conjunction with the pump 310. A fluid reservoir 448 and a pressure relief valve 450 are also associated with the pump and cooler. Two pressure relief valves, 460 and 470, are contained within the pressure relief valve device 320. If either of the two steering cylinder assemblies, 400 and 402, are subjected to a sudden impact which increases the pressure in hydraulic conduits 420 or 422, the two pressure relief valves, 460 and 470, are intended to relieve that pressure by allowing a flow of hydraulic fluid between these two hydraulic conduits, 420 and 422. In a preferred embodiment of the present invention, the two relief valves are selected to allow a crossflow of hydraulic fluid if the pressure in either of the two hydraulic conduits, 420 and 422, exceed a pressure of 2000 PSI relative to the other conduit. For example, if the pressure within hydraulic conduit 420 exceeds the pressure in hydraulic conduit 422 by greater than 2000 PSI, hydraulic fluid will flow through pressure relief valve 460 into hydraulic conduit 422 to relieve this high differential pressure.

Figure 9:
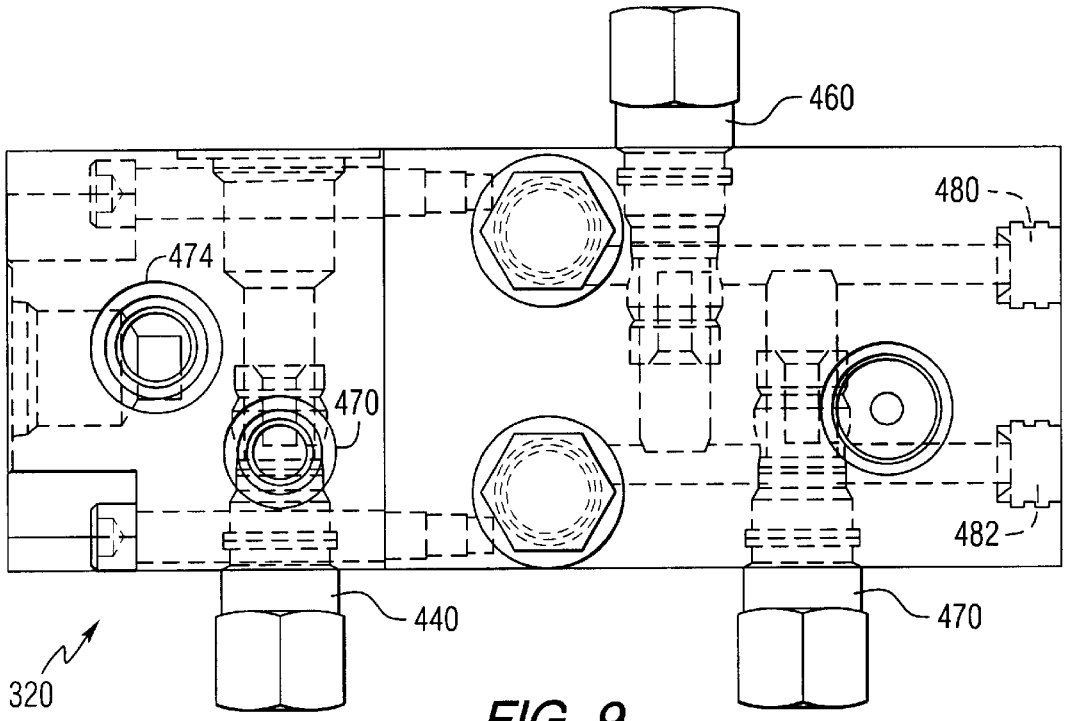
FIG. 9 is a top view of a pressure relief valve block used in conjunction with the present invention.
Figure 10:
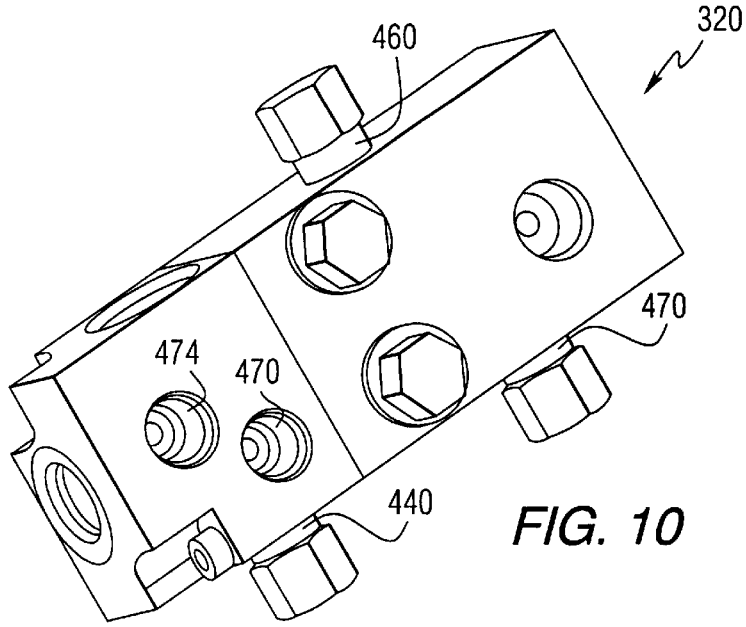
FIG. 10 is a isometric view of the pressure relief valve block shown in FIG. 9.

FIG. 9 shows the pressure relief device 320 with dashed lines illustrating internal passages within the block of the pressure relief valve device. It should be understood that the block of the pressure relief valve 320 is shaped to allow its use in conjunction with a hydraulic system having two sterndrive units. The application described above and illustrated in FIG. 7 has a single sterndrive unit 304. Therefore, some of the ports and conduits located within the block of the pressure relief valve device 320 are not used in single sterndrive unit applications. With reference to FIGS. 8 and 9, various ports of the pressure relief valve device 320 are identified in the hydraulic schematic of FIG. 8 to allow them to be compared to the view of the pressure relief valve block 320 in FIG. 9. FIG. 10 is an isometric view of the pressure relief valve device 320.

With reference to FIGS. 7–10, the location of the pressure relief valve device 320 at the rear of the marine vessel 300 allows for the second portion 332 of the hydraulic conduit to be significantly shorter than in previously known applications. If the pressure relief valve device 320 was located at the operator's console 306, the length of the second portion 332 would be significantly increased. This increased length would result in the disadvantageous delay in the activation of the pressure relief valves, 460 and 470, as described above.

With reference to FIGS. 6 and 8, the hydraulic conduits, 420 and 422, described above in conjunction with FIG. 8 are also shown in FIG. 6. A simple junction block 500 is provided under the cowl 40 described above in conjunction with FIG. 2 to simplify the inner connection of the plurality of hydraulic conduits shown in FIG. 6. Individual hydraulic conduit segments, 502, 504, 506, and 508 have been identified in FIGS. 6 and 8 to allow these two figures to be more easily compared. The hose identified by reference numeral 520 is intended to allow the junction block 500 to be connected to a trim pump for control of the trim cylinder assemblies, 82.

In some applications of sterndrive marine propulsion system, steering is accomplished with structural components located within the hull of the boat near the transom. In installations where sterndrive systems are used in high performance watercraft that operate at speeds in excess of 60 miles per hour, the use of this type of internal steering mechanism is not suggested. Instead, the steering cylinder assemblies are more effectively mounted at an aft side of the transom. These types of hydraulic steering systems, mounted behind the transom, are typically stronger and better able to withstand the significant loads caused by high speed operation and operation on rough seas. These external systems mounted to the aft side of the transom can have certain disadvantages. Aftermarket systems are mounted between the boat transom 18 and the driveshaft housing 30 of the moveable portion of the drive unit. Since the drive unit performs both trimming and steering operations, it is geometrically difficult to avoid a binding situation, or conflict between the steering cylinder assemblies and the trim cylinder assemblies as the drive unit is moved about its steering axis 62 and its trimming axis 60 during operation. This potential binding situation creates unnecessary hydraulic loads that operate on the housings and components of the sterndrive and the transom 18. The prior art system shown in FIG. 1, which is referred to as the MerCruiser Six SSM sterndrive unit provides steering cylinders mounted between the gimbal housing 10 and the gimbal ring 14. The single trim cylinder 24 is mounted between the gimbal ring 14 and the bell housing 12. This configuration allows for the trimming and steering functions to be generally independent from each other and it eliminates many of the geometric problems described above. Certain aftermarket systems are available in commercial quantities from the Inman Marine Corporation. One system of this type is referred to as the Stern Advantage Steering system. That configuration is basically similar to other available aftermarket external steering systems except that it combines the steering cylinder mounts with an extension box to set the drive back, in a rearward direction from the transom 18. The steering cylinder assemblies are connected between the driveshaft housing and the extension box which is rigidly attached to the boat transom. Although advantages are achieved by the setback provided by the extension box, this configuration also experiences the inherent geometry problems encountered by other known external steering systems.

The present invention is most advantageous on marine propulsion systems that intentionally set the drive unit back in an aft direction from the transom 18. For example, this setback result is aided by the extension housing 200 shown in FIG. 4. The present invention further provides the advantage of positioning the steering cylinder assembly 80 and the trim cylinder assembly 82 in the advantageous configuration shown in FIG. 2, where both assemblies are attached directly to a common second structural member 102. This common mounting point 102, on the gimbal ring 14, for both the trim cylinder assembly 82 and the steering cylinder assembly 80 allows for the steering cylinders to absorb much of the load induced by the trim cylinders without requiring the gimbal ring 14 to transfer the loads as on certain systems known in the prior art. To relieve the load on the gimbal ring 14, the second end 122 of the steering cylinder assembly 80 is attached at a point very close to where the first end 87 of the trim cylinder assembly is attached. To allow this second end 122 and first end 87 to be attached in close proximity to each other, the generally triangular plate is rigidly attached to the gimbal ring 14 to serve as the second structural member 102. This is clearly shown in FIG. 2 and in the exploded view of FIG. 6.

The other significant advantage provided by the marine propulsion system of the present invention is that the cross port relief valves, 460 and 470, are located in a pressure relief valve device 320 which is positioned at the rear portion of a marine vessel 300 very near the steering cylinders. This allows the second portion 332 of the hydraulic conduit to be significantly shorter than in known systems. This reduction in length of the second portion 332 protects the hoses and drive components in the event of an emergency situation. The cross port relief valves supplied on other systems are located at the operator console 306 near the front portion of the boat. Their location limits the response time for them to react and also fails to protect the hoses from excessive pressure. In an emergency situation, when the drive unit and related components are subjected to a sudden load, valve reaction time is critical if they are to prevent major structural failure to the drive components.

An inherent advantage in the present invention is the standoff feature, or setback feature, which is built into the transom assembly. As described above, the extension housing 200 shown in FIG. 4 moves the location of the propeller 66 rearwardly approximately 7 inches from its normal location where it would be located if this setback feature was not implemented. The advantage of this setback is that certain step hull boats tend to create aerated water behind the transom as the water passes from a position under the boat to a position immediately behind the transom. By moving the location of the gearcase rearwardly by approximately 7 inches, the propeller is allowed to operated in less aerated water which improves the efficiency of the propeller's operation.

Although the present invention has been described with particular specificity and illustrated to show a most preferred embodiment, it should be understood that alternative embodiments are also within its scope.

What is claimed is:

1. A marine propulsion system, comprising:

a drive unit attachable to a transom of a marine vessel and comprising a fixed portion and a movable portion, said movable portion of said drive unit being independently rotatable about a generally vertical steering axis and about a generally horizontal trimming axis;

a steering cylinder assembly extending between first and second structural members, a first end of said steering cylinder assembly being pivotally attached to of said first structural member which is rigidly attached to said transom, a second end of said steering cylinder assembly being pivotally attached to said second structural member which is rigidly attached to said movable portion of said drive unit, said movable portion of said drive unit being rotatable about said steering axis in response to a change in the effective distance between said first and second structural members; and a trim cylinder assembly extending between said second structural member and a third structural member, a first end of said trim cylinder assembly being pivotally attached to said second structural member, a second end of said trim cylinder assembly being pivotally attached to a third structural member which is rigidly attached to said movable portion of said drive unit, said movable portion of said drive unit being rotatable about said trimming axis in response to a change in the effective distance between said second and third structural members.

2. The marine propulsion system of claim 1, wherein:

said movable portion of said drive unit comprises a steering segment and a trimming segment, said steering segment being rotatable about said steering axis and said trimming segment being rotatable about said trimming axis, said second structural member being rigidly attached to said steering segment and said third structural member being rigidly attached to said trimming segment.

3. The marine propulsion system of claim 1, wherein:

said steering cylinder assembly comprises a steering piston disposed within a steering cylinder, said steering piston being movable relative to said steering cylinder to cause said change in the effective distance between said first and second structural members.

4. The marine propulsion system of claim 3, wherein:

said steering piston is pivotally attached to said second structural member and said steering cylinder is pivotally attached to said first structural member.

5. The marine propulsion system of claim 1, wherein:

said trim cylinder assembly comprises a trim piston disposed within a trim cylinder, said trim piston being movable relative to said trim cylinder to cause said change in the effective distance between said second and third structural members.

6. The marine propulsion system of claim 5, wherein:

said trim piston is pivotally attached to said third structural member and said trim cylinder is pivotally attached to said second structural member.

7. The marine propulsion system of claim 1, wherein:

said second end of said steering cylinder assembly is pivotable about a first axis which is fixed in relation to said second structural member.

8. The marine propulsion system of claim 7, wherein:

said first end of said trim cylinder assembly is pivotable about a second axis which is in fixed relation to said second structural member, said first and second axes being in fixed relation with each other.

9. The marine propulsion system of claim 1, further comprising:

a hydraulic pump;

a hydraulic conduit, having a first portion and a second portion, connected between said steering cylinder assembly and said hydraulic pump;

a steering mechanism operatively associated with said hydraulic conduit to affect a pressure magnitude within said hydraulic conduit and cause said steering cylinder assembly to change said effective distance between said first and second structural members; and a pressure relief valve connected in fluid communication with said hydraulic is conduit for limiting a hydraulic pressure magnitude within said hydraulic conduit, said first portion of said hydraulic conduit being connected in fluid communication between said steering mechanism and said pressure relief valve, said second portion of said hydraulic conduit being connected in fluid communication between said steering cylinder assembly and said pressure relief valve, said first portion of said hydraulic conduit being greater in length than said second portion of said hydraulic conduit.

10. The marine propulsion system of claim 9, wherein:

said first portion of said hydraulic conduit being at least twice as long as said second portion of said hydraulic conduit.

11. A marine propulsion system, comprising:

a drive unit attachable to a transom of a marine vessel and comprising a fixed portion and a movable portion, said movable portion of said drive unit being independently rotatable about a generally vertical steering axis and about a generally horizontal trimming axis;

a steering cylinder assembly extending between first and second structural members, a first end of said steering cylinder assembly being pivotally attached to said first structural member which is rigidly attached to said transom, a second end of said steering cylinder assembly being pivotally attached to said second structural member which is rigidly attached to said movable portion of said drive unit, said movable portion of said drive unit being rotatable about said steering axis in response to a change in the effective distance between said first and second structural members;

a trim cylinder assembly extending between said second structural member and a third structural member, a first end of said trim cylinder assembly being pivotally attached to said second structural member, a second end of said trim cylinder assembly being pivotally attached to a third structural member which is rigidly attached to said movable portion of said drive unit, said movable portion of said drive unit being rotatable about said trimming axis in response to a change in the effective distance between said second and third structural members, said steering cylinder assembly comprising a steering piston disposed within a steering cylinder, said steering piston being movable relative to said steering cylinder to cause said change in the effective distance between said first and second structural members, said trim cylinder assembly comprising a trim piston disposed within a trim cylinder, said trim piston being movable relative to said trim cylinder to cause said change in the effective distance between said second and third structural members;

a hydraulic pump;

a hydraulic conduit, having a first portion and a second portion, connected between said steering cylinder assembly and said hydraulic pump;

a steering mechanism operatively associated with said hydraulic conduit to affect a pressure magnitude within said hydraulic conduit and cause said steering cylinder assembly to change said effective distance between said first and second structural members; and a pressure relief valve connected in fluid communication with said hydraulic conduit for limiting a hydraulic pressure magnitude within said hydraulic conduit, said first portion of said hydraulic conduit being connected in fluid communication between said steering mechanism and said pressure relief valve, said second portion of said hydraulic conduit being connected in fluid communication between said steering cylinder assembly and said pressure relief valve, said first portion of said hydraulic conduit being greater in length than said second portion of said hydraulic conduit.

12. The marine propulsion system of claim 11, wherein:

said movable portion of said drive unit comprises a steering segment and a trimming segment, said steering segment being rotatable about said steering axis and said trimming segment being rotatable about said trimming axis, said second structural member being rigidly attached to said steering segment and said third structural member being rigidly attached to said trimming segment.

13. The marine propulsion system of claim 11, wherein:

said steering piston is pivotally attached to said second structural member and said steering cylinder is pivotally attached to said first structural member.

14. The marine propulsion system of claim 13, wherein:

said trim piston is pivotally attached to said third structural member and said trim cylinder is pivotally attached to said second structural member.

15. The marine propulsion system of claim 14, wherein:

said second end of said steering cylinder assembly is pivotable about a first axis which is fixed in relation to said second structural member.

16. The marine propulsion system of claim 15, wherein:

said first end of said trim cylinder assembly is pivotable about a second axis which is in fixed relation to said second structural member, said first and second axes being in fixed relation with each other.

17. The marine propulsion system of claim 11, wherein:

said first portion of said hydraulic conduit being at least twice as long as said second portion of said hydraulic conduit.

18. A marine propulsion system, comprising:

a drive unit attachable to a transom of a marine vessel and comprising a fixed portion and a movable portion, said movable portion of said drive unit being independently rotatable about a generally vertical steering axis and about a generally horizontal trimming axis;

a steering cylinder assembly extending between first and second structural members, a first end of said steering cylinder assembly being pivotally attached to said first structural member which is rigidly attached to said transom, a second end of said steering cylinder assembly being pivotally attached to said second structural member which is rigidly attached to said movable portion of said drive unit, said movable portion of said drive unit being rotatable about said steering axis in response to a change in the effective distance between said first and second structural members; and a trim cylinder assembly extending between said second structural member and a third structural member, a first end of said trim cylinder assembly being pivotally attached to said second structural member, a second end of said trim cylinder assembly being pivotally attached to a third structural member which is rigidly attached to said movable portion of said drive unit, said movable portion of said drive unit being rotatable about said trimming axis in response to a change in the effective distance between said second and third structural members, said movable portion of said drive unit comprising a steering segment and a trimming segment, said steering segment being rotatable about said steering axis and said trimming segment being rotatable about said trimming axis, said second structural member being rigidly attached to said steering segment and said third structural member being rigidly attached to said trimming segment, said steering cylinder assembly comprising a steering piston disposed within a steering cylinder, said steering piston being movable relative to said steering cylinder to cause said change in the effective distance between said first and second structural members.

19. The marine propulsion system of claim 18, wherein:

said steering piston is pivotally attached to said second structural member and said steering cylinder is pivotally attached to said first structural member, said trim cylinder assembly comprising a trim piston disposed within a trim cylinder, said trim piston being movable relative to said trim cylinder to cause said change in the effective distance between said second and third structural members, said trim piston being pivotally attached to said third structural member and said trim cylinder is pivotally attached to said second structural member, said second end of said steering cylinder assembly being pivotable about a first axis which is fixed in relation to said second structural member, said first end of said trim cylinder assembly being pivotable about a second axis which is in fixed relation to said second structural member, said first and second axes being in fixed relation with each other.

20. The marine propulsion system of claim 18, further comprising:

a hydraulic pump;

a hydraulic conduit, having a first portion and a second portion, connected between said steering cylinder assembly and said hydraulic pump;

a steering mechanism operatively associated with said hydraulic conduit to affect a pressure magnitude within said hydraulic conduit and cause said steering cylinder assembly to change said effective distance between said first and second structural members; and a pressure relief valve connected in fluid communication with said hydraulic conduit for limiting a hydraulic pressure magnitude within said hydraulic conduit, said first portion of said hydraulic conduit being connected in fluid communication between said steering mechanism and said pressure relief valve, said second portion of said hydraulic conduit being connected in fluid communication between said steering cylinder assembly and said pressure relief valve, said first portion of said hydraulic conduit being greater in length than said second portion of said hydraulic conduit.

* * * * *